US010328698B2

(12) United States Patent
Mizuno

(10) Patent No.: US 10,328,698 B2
(45) Date of Patent: Jun. 25, 2019

(54) LIQUID DISCHARGE APPARATUS

(71) Applicant: Brother Kogyo Kabushiki Kaisha, Nagoya-shi, Aichi-ken (JP)

(72) Inventor: Taisuke Mizuno, Yokkaichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/933,484

(22) Filed: Mar. 23, 2018

(65) Prior Publication Data

US 2019/0092013 A1 Mar. 28, 2019

(30) Foreign Application Priority Data

Sep. 26, 2017 (JP) ..... 2017-184830

(51) Int. Cl.
*B41J 2/14* (2006.01)
*B41J 2/16* (2006.01)

(52) U.S. Cl.
CPC ..... *B41J 2/14233* (2013.01); *B41J 2/161* (2013.01); *B41J 2/14072* (2013.01); *B41J 2002/14491* (2013.01); *B41J 2202/18* (2013.01)

(58) Field of Classification Search
CPC .... B41J 2/14233; B41J 2/161; B41J 2/14072; B41J 2202/18; B41J 2002/14491
See application file for complete search history.

(56) References Cited

U.S. PATENT DOCUMENTS

| | | | |
|---|---|---|---|
| 9,573,371 | B2 | 2/2017 | Hamaguchi et al. |
| 2016/0263889 | A1 | 9/2016 | Hamaguchi et al. |
| 2017/0057222 | A1 | 3/2017 | Nanba et al. |
| 2018/0015717 | A1 | 1/2018 | Tanaka |

FOREIGN PATENT DOCUMENTS

| | | | | |
|---|---|---|---|---|
| JP | WO 2016/092747 | A1 * | 6/2016 | ..... B41J 2/14 |
| JP | 2016-165863 | A | 9/2016 | |
| JP | 2016-172345 | A | 9/2016 | |
| JP | 2017-042953 | A | 3/2017 | |
| WO | 2016/147634 | A1 | 9/2016 | |

* cited by examiner

*Primary Examiner* — Geoffrey S Mruk
(74) *Attorney, Agent, or Firm* — Banner & Witcoff, Ltd.

(57) ABSTRACT

A liquid discharge apparatus includes: a channel substrate; a first substrate; a piezoelectric element; a spacer, which is provided on a surface of the first substrate on which the piezoelectric element is disposed; a second substrate; and a bump electrode, wherein the spacer is provided between the bump electrode and the piezoelectric element and attached to at least one of the first and second substrates by an adhesive, and wherein both a space on a side of the piezoelectric element with respect to the spacer and a space on a side of the bump electrode with respect to the spacer are opened by at least one of a portion other than a portion of the spacer positioned between the piezoelectric element and the bump electrode and an opening provided in at least one of the first and second substrates.

9 Claims, 14 Drawing Sheets

LIQUID DISCHARGE APPARATUS

CROSS-REFERENCE TO RELATED APPLICATION

This application claims priority from Japanese Patent Application No. 2017-184830 filed on Sep. 26, 2017 the entire subject matter of which is incorporated herein by reference.

TECHNICAL FIELD

This disclosure relates a liquid discharge apparatus.

BACKGROUND

As a liquid discharge apparatus according to the background art, a liquid jetting head disclosed is known. In an example of the liquid jetting head, a spacer is interposed between an actuator substrate and a sealing plate. The spacer is attached to the actuator substrate through an adhesive so as to surround a bump electrode protruding from the actuator substrate toward the sealing plate. Furthermore, piezoelectric element constituting the actuator substrate is disposed outside the closed space surrounded by the spacer.

In another example of the liquid jetting head, a frame-shaped spacer is provided between a sealing plate and an actuator substrate so as to surround a piezoelectric element. The piezoelectric element is displaced to cause a pressure variation of liquid in a pressure chamber formed in the actuator substrate, such that the liquid is jetted from a nozzle communicating with the pressure chamber.

SUMMARY

In the one example of the liquid jetting head according to background art, the piezoelectric element is disposed outside the closed space surrounded by the spacer. Accordingly, gas generated from the adhesive for attaching the spacer and the actuator to each other may be confined in the closed space and suppressed from reaching the piezoelectric element, which prevents a problem such as deterioration of the piezoelectric element due to the gas. However, since the pressure of the closed space is raised by the gas, the bump electrode may be separated by the pressure.

In another example of the liquid jetting head, the piezoelectric element is stored in the closed space surrounded by the spacer. In the closed space, the pressure is raised by the gas of the adhesive, and the displacement of the piezoelectric element is inhibited. Therefore, a desired amount of liquid may not be jetted from the nozzle.

This disclosure is to provide a liquid discharge apparatus capable of suppressing reduction in displacement of a piezoelectric element and suppressing a problem due to gas generated from an adhesive.

A liquid discharge apparatus of this disclosure includes: a channel substrate, which has a pressure chamber communicating with a nozzle; a first substrate, which is disposed on the channel substrate; a piezoelectric element, which is disposed on the first substrate so as to correspond to the pressure chamber; a spacer, which is provided on a surface of the first substrate on which the piezoelectric element is disposed; a second substrate, which is stacked over the first substrate with the spacer interposed therebetween; and a bump electrode, which communicates with the piezoelectric element and electrically connects a first terminal provided on the first substrate with a second terminal provided on the second substrate. The spacer is provided between the bump electrode and the piezoelectric element and attached to at least one of the first and second substrates by an adhesive. Both a space on a side of the piezoelectric element with respect to the spacer and a space on a side of the bump electrode with respect to the spacer are opened by at least one of a portion other than a portion of the spacer positioned between the piezoelectric element and the bump electrode and an opening provided in at least one of the first and second substrates.

According to the configuration, a space on the side of the bump electrode with respect to the spacer is opened by the opening. Therefore, a pressure rise in the space is suppressed, and a problem such as separation of the bump electrode due to the high pressure is suppressed.

Since the opening is provided at the portion other than the portion positioned between the piezoelectric element and the bump electrode of the spacer, gas discharged from the opening does not directly flow toward the piezoelectric element from the bump electrode. Accordingly, the gas can be suppressed from reaching the piezoelectric element, whereby a problem of the piezoelectric element due to the gas is suppressed.

The space on the side of the piezoelectric element with respect to the spacer is opened by the opening. Therefore, a pressure rise in the space can be suppressed, and displacement reduction of the piezoelectric element due to a high pressure can be suppressed.

BRIEF DESCRIPTION OF THE DRAWINGS

The foregoing and additional features and characteristics of this disclosure will become more apparent from the following detailed descriptions considered with the reference to the accompanying drawings, wherein.

DETAILED DESCRIPTION

Figure 1:
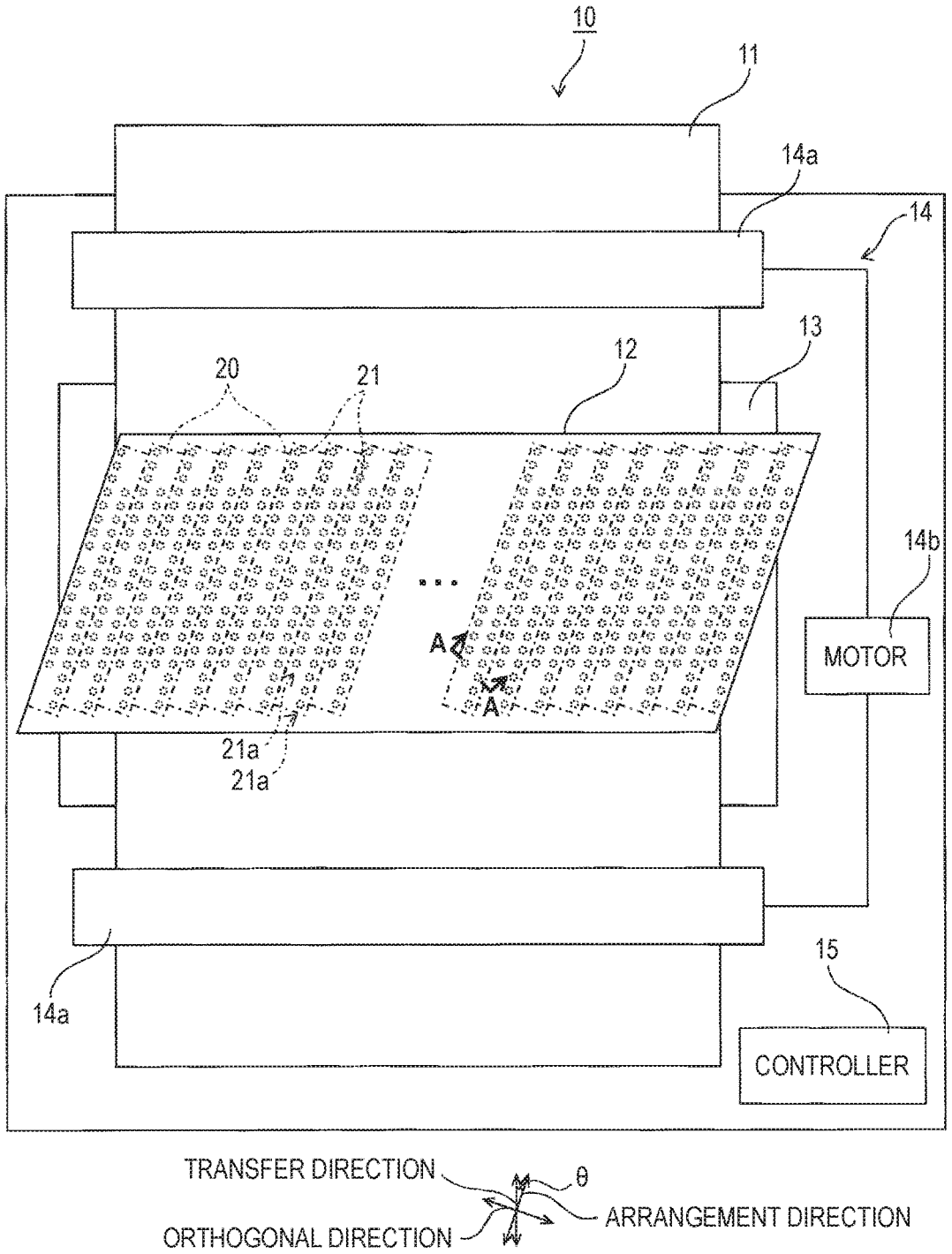
FIG. 1 schematically illustrates a liquid discharge apparatus according to a first embodiment of this disclosure.

Hereafter, exemplary embodiments of this disclosure will be described in detail with reference to the accompanying drawings. The same or corresponding elements throughout the whole drawings are represented by like reference numerals, and the duplicated descriptions thereof will be omitted.

First Embodiment

Liquid Discharge Apparatus

As illustrated in FIG. 1, a liquid discharge apparatus 10 according to a first embodiment of this disclosure is a printer, for example, that prints a text or image on a recording medium 11 such as paper with liquid such as ink. The liquid discharge apparatus 10 includes a head unit 12, a platen 13, a transfer mechanism 14 and a controller 15. The liquid discharge apparatus 10 is a line-type printer which performs printing while the position of the head unit 12 is fixed in the liquid discharge apparatus 10. However, the liquid discharge apparatus 10 may include a printer in which the head unit 12 is moved in a direction perpendicular to the transfer direction of the recording medium 11.

The head unit 12 includes a plurality of heads 20, and the plurality of heads 20 are arranged in parallel to a direction perpendicular to the transfer direction. Each of the heads 20 includes a plurality of nozzles 21 for jetting liquid. The head 20 will be described in detail later.

The platen 13 serves as a base on which the recording medium 11 is placed, and is disposed so as to face a nozzle surface to which the nozzles 21 of the heads 20 are opened. The transfer mechanism 14 for transferring the recording medium 11 includes four rollers 14*a* and a transfer motor 14*b* for driving the rollers 14*a*. The four rollers 14*a* are set to two pairs of rollers, and the two pairs of rollers 14*a* are disposed so as to interpose the platen 13 therebetween in the transfer direction. Each pair of rollers 14*a* is disposed so as to interpose the recording medium 11 therebetween, and rotated in the opposite direction by the transfer motor 14*b* to transfer the recording medium 11 along the transfer direction.

The controller 15 includes an operation unit (not illustrated) and a memory unit (not illustrated). The operation unit is constituted by a processor and the like, and the memory unit is constituted by a memory which the operation unit can access. As a program stored in the memory unit is executed by the operation unit, the respective units of the liquid discharge apparatus 10 are controlled.

Head

As illustrated in FIG. 1, the plurality of nozzles 21 in each of the heads 20 form columns (nozzle columns 21*a*) arranged in a straight line shape in a direction (arrangement direction) having a predetermined angle θ with respect to the transfer direction. Specifically, two nozzle columns 21*a* are provided in parallel to each other, with a space formed therebetween in a direction perpendicular to the arrangement direction. The two nozzle columns 21*a* include an equal number of nozzles 21. The angle θ of the arrangement direction with respect to the transfer direction is set in the range of 30 to 60 degrees.

Figure 2:
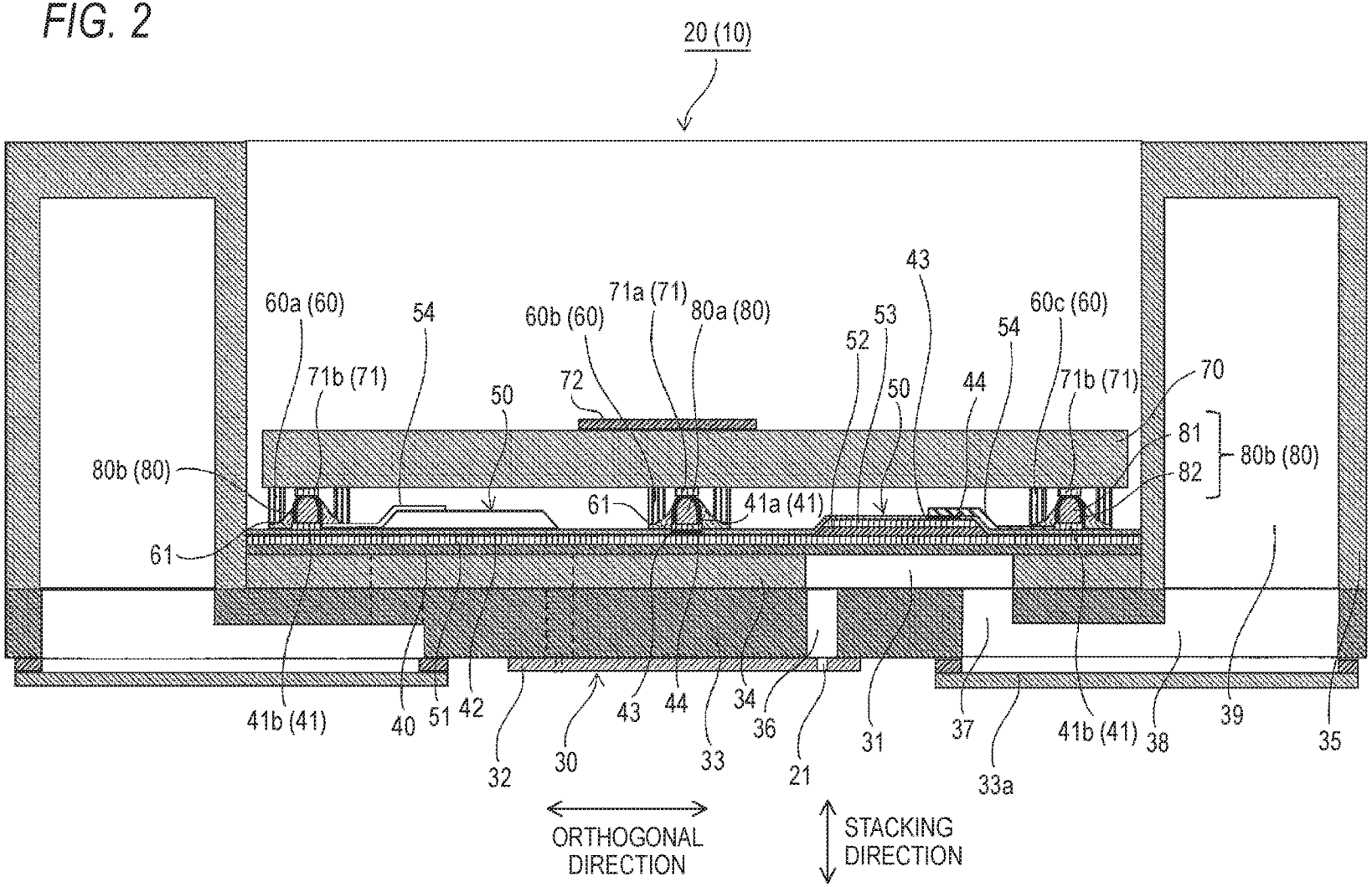
FIG. 2 is a cross-sectional view of a head taken along the line A-A of FIG. 1.
Figure 3:
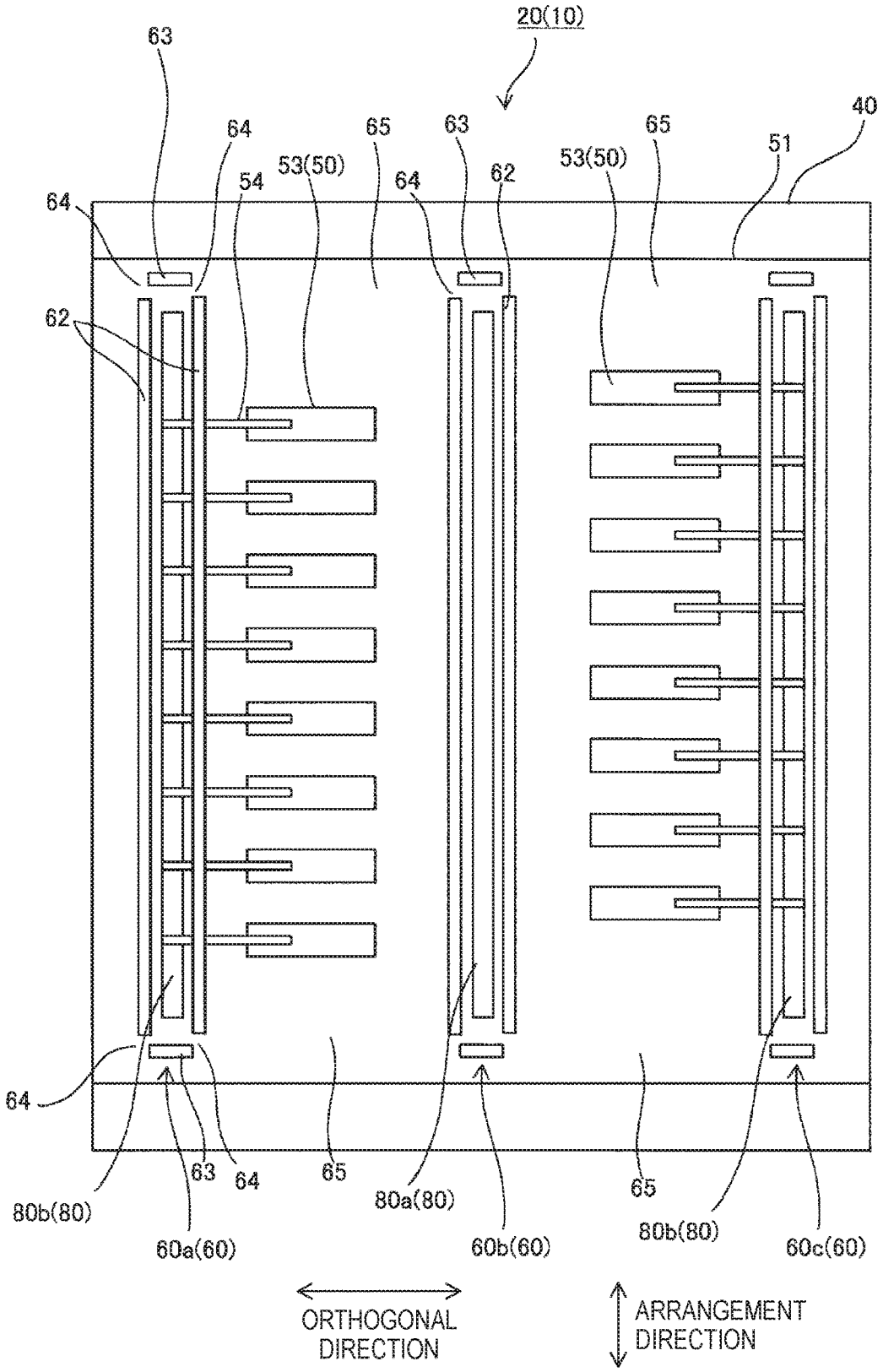
FIG. 3 illustrates the head on a first substrate of FIG. 2.

As illustrated in FIGS. 2 and 3, the head 20 includes a channel substrate 30, a first substrate 40, a piezoelectric element 50, a spacer 60, a second substrate 70 and a bump electrode 80. The channel substrate 30 includes a pressure chamber 31 communicating with the nozzle 21, and includes a nozzle plate 32, a channel plate 33, a pressure chamber plate 34 and a reservoir member 35, which are stacked therein.

The nozzle plate 32 includes a plurality of nozzles 21 formed therethrough in the stacking direction of the plate. The bottom surface of the nozzle plate 32 is a nozzle surface through which the nozzles 21 are opened.

The channel plate 33 is stacked over the nozzle plate 32, and a descender 36, a branch channel 37 and a manifold 38 are formed in the channel plate 33. The descender 36 is formed through the channel plate 33 in the stacking direction so as to communicate with the nozzle 21.

The branch channel 37 is a channel for branching into the plurality of pressure chambers 31 from the manifold 38. The branch channel 37 is formed through the channel plate 33 in the stacking direction so as to communicate with the manifold 38 and the pressure chamber 31. The manifold 38 serves as a part of a channel (supply channel) for supplying liquid to the plurality of pressure chambers 31, and is formed through the channel plate 33 in the stacking direction so as to extend in the arrangement direction.

The channel plate 33 includes a damper film 33*a* attached to the bottom surface thereof, such that the damper film 33*a* covers the manifold 38. The damper film 33*a* defines a part of the manifold 38. The damper film 33*a* made of a flexible film-shaped member is deformed to suppress a pressure variation of liquid in the manifold 38.

The pressure chamber 31 of the pressure chamber plate 34 is formed through the pressure chamber plate 34 in the stacking direction so as to connect the descender 36 and the branch channel 37. Accordingly, the pressure chamber 31 communicates with the nozzle 21 through the descender 36, and communicates with the manifold 38 through the branch channel 37.

The reservoir member 35 is stacked on the channel plate 33 outside the pressure chamber plate 34, and includes a reservoir 39 formed therein. The reservoir 39 is opened through the bottom surface of the reservoir member 35 so as to communicate with the manifold 38. Accordingly, the reservoir 39 forms a supply path with the manifold 38, the supply path being used for supplying liquid to the plurality of pressure chambers 31 through the branch channels 37.

The first substrate 40 is an insulating plate for supporting a first terminal 41, for example, a vibration plate. The first substrate 40 is stacked over the pressure chamber plate 34 of the channel substrate 30, and covers the plurality of pressure chambers 31 of the pressure chamber plate 34. The piezoelectric element 50 is disposed on the first substrate 40 so as to correspond to the pressure chamber 31.

The piezoelectric element 50 includes a common electrode 51, a piezoelectric body 52 and a discrete electrode 53. The common electrode 51 serving as a common electrode for the plurality of piezoelectric elements 50 is stacked on the first substrate 40 so as to cover the entire first substrate 40. The piezoelectric body 52 is disposed on each of the pressure chambers 31, and the discrete electrode 53 is disposed on the piezoelectric body 52. Therefore, the discrete electrode 53 is provided for each of the piezoelectric elements 50.

When a voltage is applied to the discrete electrode 53, the piezoelectric body 52 is deformed to displace the first substrate 40. As the first substrate 40 is displaced toward the pressure chamber 31, the volume of the pressure chamber 31 is reduced, and pressure is applied to liquid in the pressure chamber 31, such that the liquid is discharged from the nozzle 21 communicating with the pressure chamber 31.

A protection film 42 is stacked on the discrete electrode 53 and the common electrode 51. The protection film 42 is formed of aluminum oxide (alumina: $Al_2O_3$), for example, and protects the piezoelectric body 52 from moisture in the air. The protection film 42 has a through-hole 43 formed therein, and the through-hole 43 is filled with a conductive material 44. The protection film 42 includes a plurality of individual conductors 54 provided thereon, the plurality of individual conductors 54 corresponding to the respective discrete electrodes 53. The individual conductors 54 on the protection film 42 and the discrete electrodes 53 on the protection film 42 are electrically connected to each other through the conductive material 44. In the present embodiment, the plurality of piezoelectric elements 50 are arranged in the arrangement direction, and form two columns corresponding to the two nozzle columns 21*a*. The individual conductor 54 extends from the discrete electrode 53 of the piezoelectric element 50 toward the opposite side (outside) of the center of the two piezoelectric element columns, and electrically connected to the first terminal 41.

The second substrate 70 is an insulating plate for supporting a second terminal 71, and stacked over the first substrate 40 through the spacer 60. The second terminal 71 over the second substrate 70 is electrically connected to the first terminal 41 on the first substrate 40 through the bump electrode 80. The spacer 60 and the bump electrode 80 will be described in detail later.

The second substrate 70 includes a driver IC 72 mounted thereon. The driver IC 72 is electrically connected to a wiring connected to the second terminal 71, and the wiring is electrically connected to the controller 15 (FIG. 1). Accordingly, the controller 15 is connected to the driver IC 72 and the second terminal 71 through the wiring, the second terminal 71 is connected to the first terminal 41 through the bump electrode 80, and the first terminal 41 is connected to the discrete electrode 53 through the individual conductor 54. Therefore, the driver IC 72 generates a driving signal for driving the piezoelectric element 50 based on a signal from the controller 15, and outputs the driving signal to the discrete electrode 53.

Bump Electrode

As illustrated FIG. 2, the bump electrode 80 includes an elastic internal resin 81 and a conductive film 82 covering the internal resin 81. The bump electrode 80 protrudes from the first substrate 40 toward the second substrate 70 so as to be elastically deformed between the first and second substrates 40 and 70. The bump electrode 80 is electrically connected to the first terminal 41 of the first substrate 40 and the second terminal 71 of the second substrate 70.

The first terminal 41 includes a terminal (common terminal 41*a*) communicating with the common electrode 51 of the piezoelectric element 50 and a terminal (power receiving terminal 41*b*) communicating with the discrete electrode 53 of the piezoelectric element 50. The second terminal 71 includes a ground terminal 71*a* and a terminal (power supply terminal 71*b*) communicating with the driver IC 72.

The common terminal 41*a* is electrically connected to the common electrode 51 through the conductive material 44 filling the through-hole 43 of the protection film 42 which covers the common electrode 51. For example, the common terminal 41*a* is disposed between the two piezoelectric element columns arranged with a gap formed therebetween in the orthogonal direction. The power receiving terminal 41*b* is electrically connected to the discrete electrode 53 through the conductive material 44 and the individual conductor 54. For example, the power receiving terminal 41*b* is provided at an end of the discrete electrode 53 extending from the discrete electrode 53 of the piezoelectric element 50 toward the opposite side of the common terminal 41*a*.

As illustrated in FIG. 3, the bump electrode 80 extends in the arrangement direction. For example, a plurality (three) of bump electrodes 80 are arranged in parallel to each other with an interval provided therebetween in the orthogonal direction. The bump electrode 80 may include an electrode (common bump electrode 80*a*) electrically connected to the common terminal 41*a* and the ground terminal 71*a* and an electrode (individual bump electrode 80*b*) electrically connected to the power receiving terminal 41*b* and a power feeding terminal 71*b*. For example, two individual bump electrodes 80*b* are provided so as to correspond to two piezoelectric element columns. Between the two piezoelectric element columns, the common bump electrode 80*a* is disposed.

Spacer

As illustrated in FIGS. 2 and 3, the spacer 60 serves to secure a space (holding space) for holding the bump electrode 80 between the first and second substrates 40 and 70, and is provided between the bump electrode 80 and the piezoelectric elements 50. The spacer 60 is formed on the surface of the second substrate 70, facing the first substrate 40, and protrudes from the second substrate 70 toward the first substrate 40. The protrusion dimension of the spacer 60 is set to such an extent that the first terminal 41 of the first substrate 40 and the second terminal 71 of the second substrate 70 are electrically connected to the bump electrode 80.

The protruding end of the spacer 60 is connected to the first substrate 40 through an adhesive 61. As the adhesive 61, a non-conductive adhesive is used in order to prevent a short circuit between wirings. The adhesive 61 is applied to an adhesion region in which the end of the spacer 60 overlaps the first substrate 40 and a region closer to the bump electrode 80 than the adhesion region. Accordingly, the spacer 60 and the first substrate 40 can be reliably attached to each other, and the adhesive 61 can be suppressed from spreading and adhering to the piezoelectric element 50.

The spacer 60 is formed in a rectangular frame shape to surround the bump electrodes 80. Therefore, the spacer 60 can secure a space between the first and second substrates 40 and 70 such that the height of the bump electrode 80 becomes more appropriate. The spacer 60 includes a pair of first wall portions 62 extending in the arrangement direction and a pair of second wall portions 63 extending in the orthogonal direction.

The pair of first wall portions 62 are disposed with a space formed therebetween so as to interpose the bump electrodes 80 in the orthogonal direction. The pair of first wall portions 62 have the same shape. The first wall portion 62 is continuous from one end to the other end thereof in the arrangement direction, and has no disconnected portions. The pair of first wall portions 62 may include a wall portion positioned on the side of the piezoelectric element 50 with respect to the bump electrode 80 in the orthogonal direction (between the piezoelectric element 50 and the bump electrode 80) and a wall portion positioned at the opposite side of the piezoelectric element 50 with respect to the bump electrode 80. The first wall portion 62 extends longer than the bump electrode 80 in the arrangement direction, such that the end thereof is positioned outside the bump electrode 80 based on the end of the bump electrode 80. Furthermore, the first wall portion 62 extends longer than the piezoelectric element column in the arrangement direction, such that the end thereof is positioned outside the piezoelectric element 50 positioned at the end of the piezoelectric element column.

The pair of second wall portions 63 are disposed with a space formed therebetween so as to interpose the bump electrodes 80 in the arrangement direction. The pair of second wall portions 63 have the same shape. The length of the second wall portion 63 in the orthogonal direction is equal to or larger than the width of the bump electrode 80, and equal to or smaller than a distance between the outer ends of the pair of first wall portions 62. The second wall portion 63 is disposed within the interval between the outer ends of the pair of first wall portions 62 in the orthogonal direction.

The spacer 60 includes an opening (first opening 64) communicating with the outside of the holding space from the holding space therein. Through the first opening 64, the space (holding space) on the side of the bump electrode 80 inside the spacer 60 is opened. Thus, the holding space surrounded by the first substrate 40, the second substrate 70 and the spacer 60 is not sealed. Therefore, it possible to suppress a pressure rise in the holding space by gas generated from the adhesive 61 of the holding space and the adhesive 61 of the adhesion region of the spacer 60, thereby preventing separation of the bump electrode 80 by the pressure rise.

For example, the first opening 64 is provided at each corner of the rectangular frame shape. Accordingly, the first opening 64 is provided at portions other than the portion positioned between the piezoelectric element 50 and the bump electrode 80. Therefore, although the gas generated from the adhesive 61 of the holding space and the adhesive 61 of the adhesion region of the spacer 60 leaks from the holding space with the outside through the first opening 64, the gas hardly flows toward the piezoelectric element 50, which prevents a deterioration of the piezoelectric element 50 due to the gas.

The first opening 64 is provided at a part of the first wall portion 62 and a part of the second wall portion 63 at the connection position between the first and second wall portions 62 and 63. Accordingly, the load of the second substrate 70 can be distributed and supported by the first and second wall portions 62 and 63 other than the first opening 64.

The first opening 64 is formed across the entire distance between the first and second substrates 40 and 70 in the stacking direction. Accordingly, since the spacer 60 is divided in the circumferential direction that surrounds the bump electrode 80, an adhesion defect between the spacer 60 and the first substrate 40 is reduced. In general, since the first substrate 40 is formed of silicon and the spacer 60 is formed of resin, the spacer 60 has a larger linear expansion coefficient than the first substrate 40. In this case, an adhesion defect may occur due to residual stress caused by a difference between the linear expansion coefficients.

However, as the spacer 60 is divided in the circumferential direction by the first opening 64, the length of the spacer 60 in the circumferential direction is reduced. Accordingly, the residual stress caused by the difference between the linear expansion coefficients can be reduced, and the reduction of the residual stress can suppress an adhesion defect between the spacer 60 and the first substrate 40.

In the present embodiment, three spacers 60 are provided in the head 20 so as to correspond to three bump electrodes 80. The three spacers 60 include a spacer (first spacer 60*a*) surrounding one of two individual bump electrodes 80*b*, a spacer (second spacer 60*a*) surrounding the common bump electrode 80*a*, and a spacer (third spacer 60*c*) surrounding the other of the two individual bump electrodes 80*b*. The first to third spacers 60*a* to 60*c* are sequentially arranged in the orthogonal direction with a distance provided therebetween.

The column of the piezoelectric elements 50 is provided in the space between the spacers 60 adjacent to each other. Therefore, one of the pair of first wall portions 62 of the first spacer 60*a*, both of the pair of first wall portions 62 of the second spacer 60*b*, and one of the pair of first wall portions 62 of the third spacer 60*c* are arranged between the columns of the piezoelectric elements and the individual bump electrodes 80*b*, respectively.

Accordingly, the second wall portions 63 of the spacer 60 are provided in the space between the adjacent spacers 60, that is, the space on the side of the piezoelectric element 50 outside the first wall portion 62 of the spacer 60. The space between the second wall portions 63 of the adjacent spacers 60 is used as an opening (second opening 65) of the spacer 60, and the space on the side of the piezoelectric elements 50 outside the first wall portion 62 is opened to the outside through the second opening 65. Since the piezoelectric elements 50 are arranged in the open space, displacement interference of the piezoelectric elements 50 in a closed space does not occur, and a desired amount of liquid can be jetted from the nozzle 21.

First Modified Example

In the liquid discharge apparatus 10 of FIG. 3, the first opening 64 of the spacer 60 is provided at the corners of the spacer 60. However, when the first opening 64 is provided at portions other than the position positioned between the piezoelectric element 50 and the bump electrode 80, the first opening 64 is not limited to the positions illustrated in FIG. 3.

Figure 4:
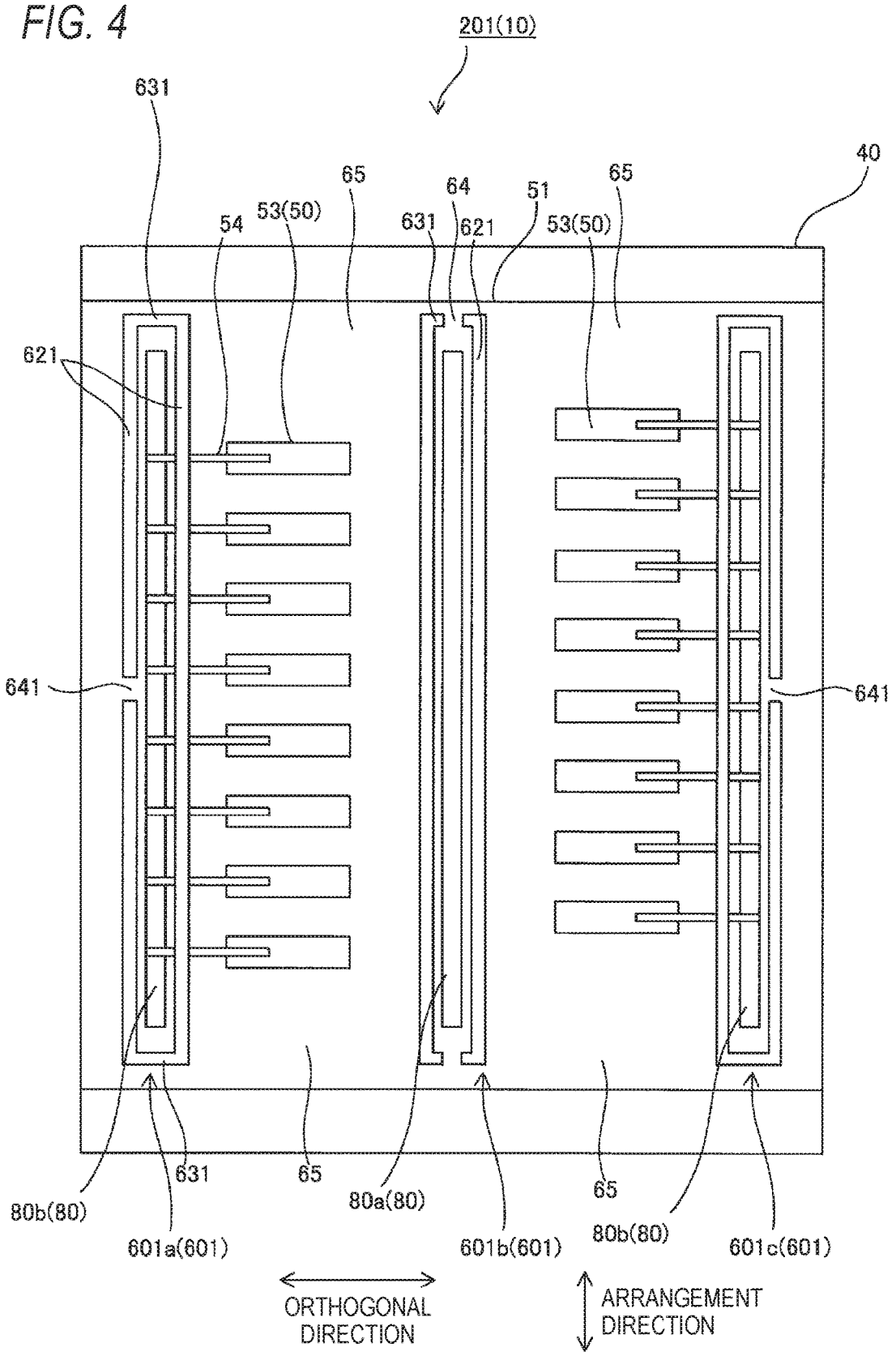
FIG. 4 illustrates a head on a first substrate of a liquid discharge apparatus according to a first modification of the first embodiment of this disclosure.

For example, each spacer 601 of a head 201 illustrated in FIG. 4 surrounds the bump electrode 80 using first and second wall portions 621 and 631. In first and third spacers 601*a* and 601*c* among the spacers 601, a first opening 641 is provided at the first wall portion 621 disposed at the opposite side of the piezoelectric element 50 with respect to the bump electrode 80. Accordingly, since gas generated from the adhesive 61 flows out to the opposite side of the piezoelectric element 50 through the first opening 641 from the holding space of the spacer 601, the gas hardly flows toward the piezoelectric element 50, which prevents a problem of the piezoelectric element 50 due to the gas.

In the second spacer 601*b*, the first opening 641 is provided at the second wall portion 631 and extends in the arrangement direction. Therefore, the gas generated from the adhesive 61 flows out in the arrangement direction through the first opening 641 from the holding space of the spacer 602. Accordingly, the gas hardly flows toward the piezoelectric element 50 adjacent to the spacer 602 in the orthogonal direction, which prevents a problem of the piezoelectric element 50 due to the gas.

Figure 5:
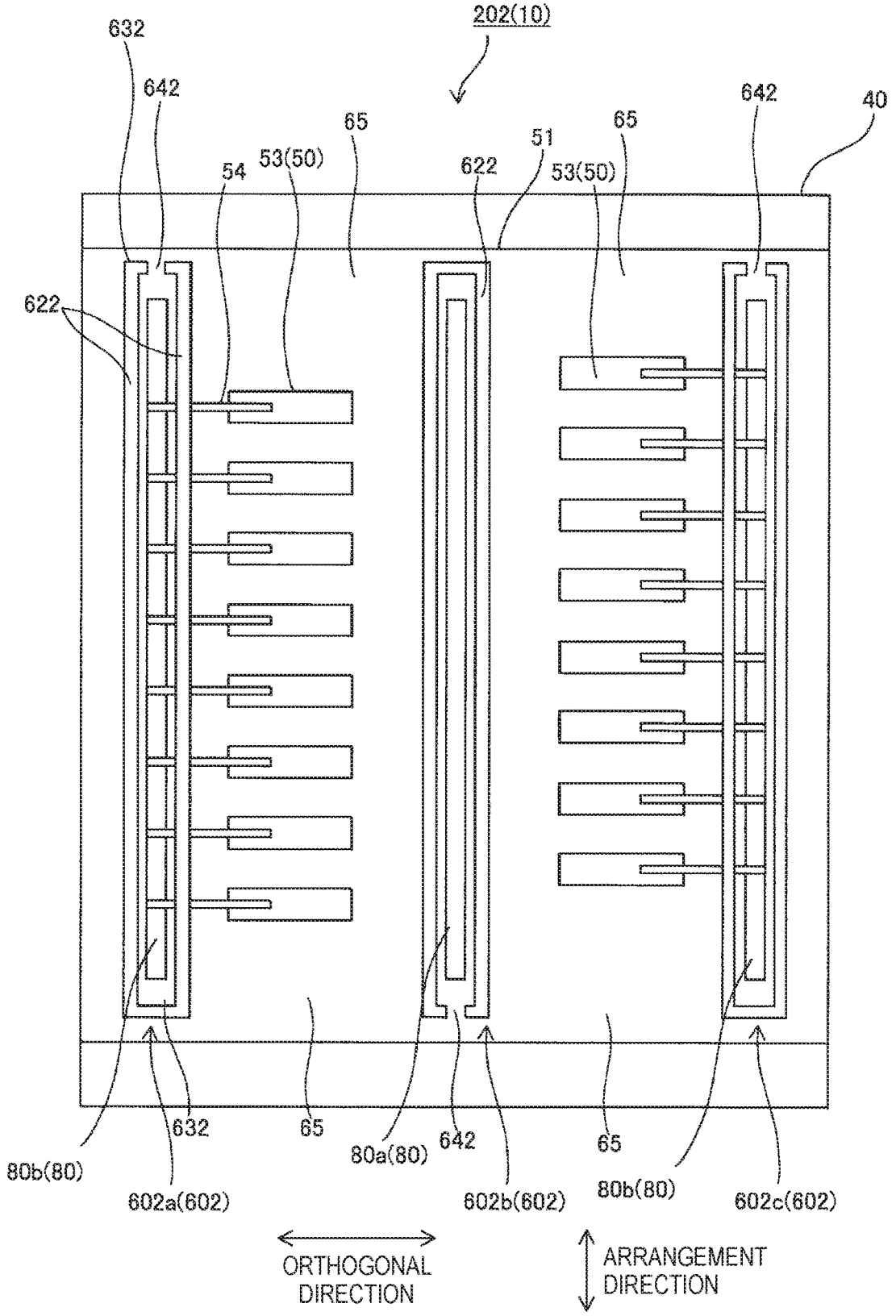
FIG. 5 illustrates a head on a first substrate of a liquid discharge apparatus according to first and second modifications of the first embodiment of this disclosure.

In an example illustrated in FIG. 5, each spacer 602 of a head 202 surrounds the bump electrode 80 using first and second wall portions 622 and 632, and includes a first opening 642 provided at the second wall portion 632. Therefore, gas generated from the adhesive 61 flows out in the arrangement direction through the first opening 642 from the holding space of the spacer 602, which prevents a problem of the piezoelectric element 50 due to the gas.

Second Modified Example

In the liquid discharge apparatus 10 illustrated in FIG. 3, the plurality of first openings 64 are formed in one spacer 60. However, the number of first openings 64 is not limited thereto. For example, in the example of the head 202 illustrated in FIG. 5, one first opening 642 is provided in the spacer 602. In this case, the first opening 642 is provided at one second wall portion 632 of the pair of second wall portions 632. In another spacer 602 adjacent to the spacer 602 among the plurality of spacers 602, the first opening 642 may be provided at the other second wall portion 632 of the pair of second wall portions 632.

That is, the second spacer 602*b* positioned in the center of three spacers 602 arranged in the orthogonal direction includes the first opening 642 formed at one second wall portion 632 of the pair of second wall portions 632. On the other hand, each of the first and second spacers 602*a* and 602*c* adjacent to the second spacer 602*b* positioned in the center includes the first opening 642 formed at the other second wall portion 632 of the pair of second wall portions 632.

For example, when the adhesive 61 for adhering the spacer 602 and the first substrate 40 hardens and contracts, the first substrate 40 may be warped. Thus, all of the spacers 602 may have the first opening 642 formed at one second wall portion 632 of the pair of the second wall portions 632. In this case, the first substrate 40 at the one second wall portion 632 having the first opening 642 formed therein is warped more than the first substrate 40 at the other second wall portion 632 having no first opening 642 formed therein. However, since the first openings 642 are formed in the three spacers 602 such that the second wall portion 632 having the first opening 642 formed therein between the pair of second wall portions 632 is alternately disposed, the warpage of the first substrate 40 can be reduced.

Third Modified Example

Figure 6:
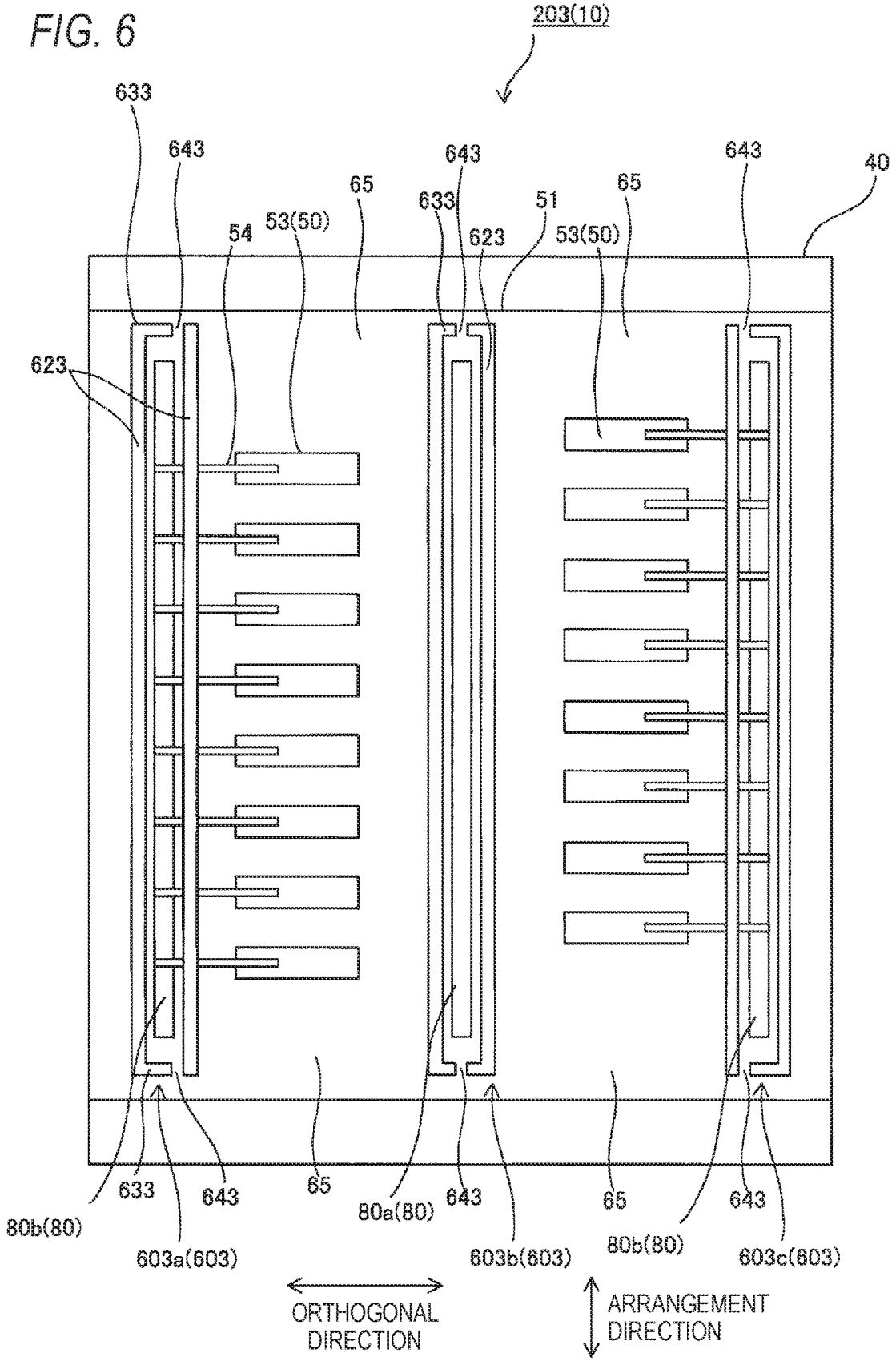
FIG. 6 illustrates a head on a first substrate of a liquid discharge apparatus according to a third modification of the first embodiment of this disclosure.

In the liquid discharge apparatus 10 illustrated in FIG. 3, the first openings 64 are provided at the same positions in each of the three spacers 60 arranged in the orthogonal direction. However, the positions of the first openings 64 are not limited thereto. As illustrated in an example of a head 302 in FIG. 6, an opening 643 may be provided at a position of a second wall portion 633, which is close to the center of each of a plurality of spacers 603 arranged in the orthogonal direction.

That is, each of the spacers 603 surrounds the bump electrode 80 using the first and second wall portions 623 and 633. The center of the three spacers 604 in the orthogonal direction corresponds to the center position of the second spacer 603*b* disposed in the center of the three spacers 603. Therefore, the second spacer 603*b* includes the first opening 643 disposed at the center position of the second wall portion in the orthogonal direction. In the first and third spacers 603*a* and 603*c* provided at both ends of the three spacers 603, however, the first opening 643 is disposed at an end of the second wall portion 633, which is close to the center position of the second spacer 603*b*.

Accordingly, in each of the three spacers 603, the lengths of both of the second wall portions 633 in the orthogonal direction are set to the same value. Furthermore, the lengths of both of the second wall portions 633 in the orthogonal direction are increased. Therefore, a deviation in warpage of the first substrate 40, caused by thermal contraction of the spacer 603 in the orthogonal direction, can be removed, and the warpage of the first substrate 40 by the thermal contraction of the spacer 603 at the end in the orthogonal direction can be increased, which makes it possible to reduce the warpage of the entire first substrate 40.

Fourth Modified Example

In the liquid discharge apparatus 10 illustrated in FIG. 3, the first opening 64 is provided at a part of the first wall portion 62 and a part of the second wall portion 63 in the extension direction. However, the first opening 64 may be provided at one or more of the entire first wall portion 62 and the entire second wall portion 63.

Figure 7:
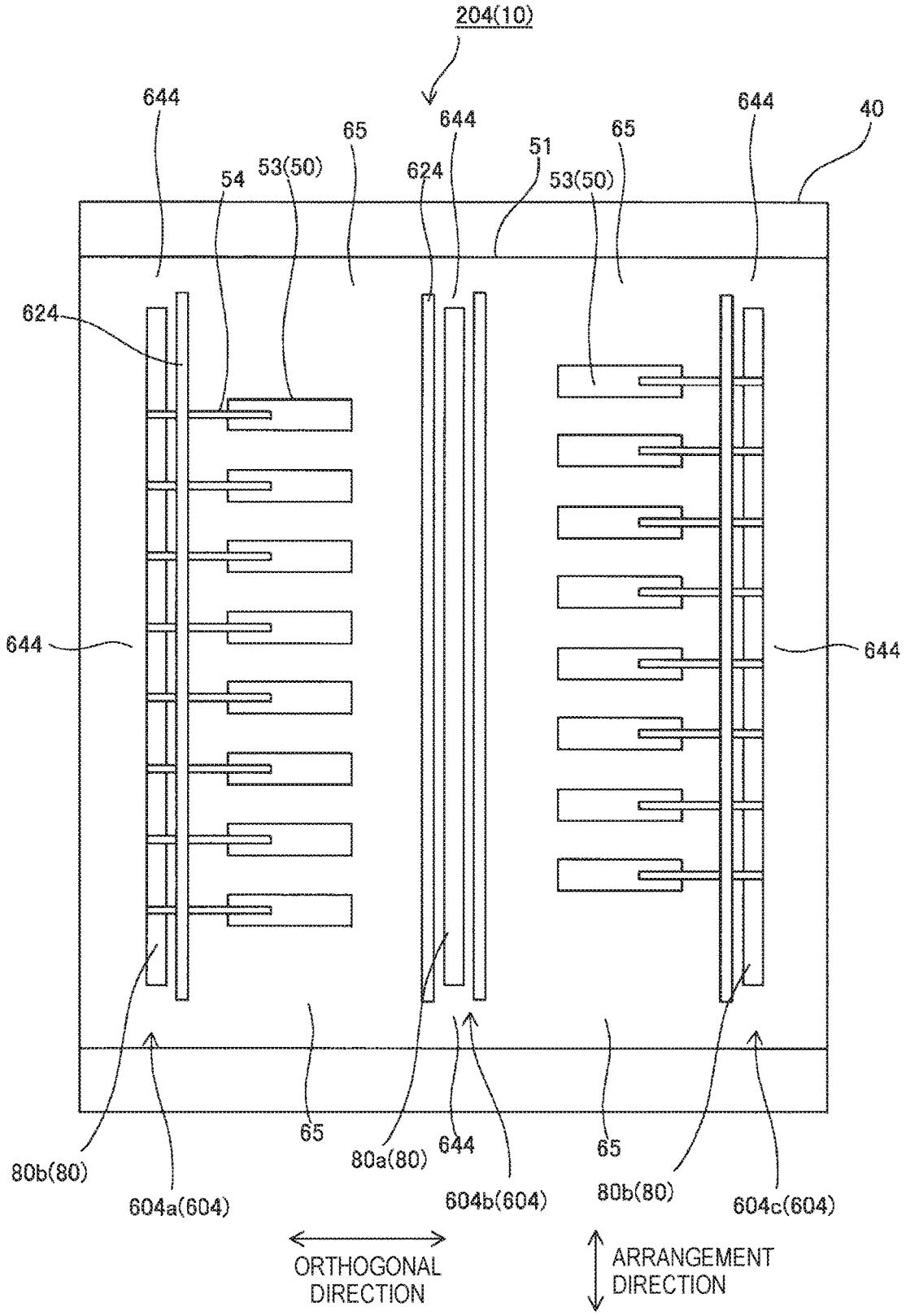
FIG. 7 illustrates a head on a first substrate of a liquid discharge apparatus according to a fourth modification of the first embodiment of this disclosure.

In an example of a head 204 illustrated in FIG. 7, a spacer 604 has no first wall portion at the opposite side of the piezoelectric element 50 with respect to the bump electrode 80, between a pair of first wall portions 624. The portion where the first wall portion is not provided is used as a first opening 644. Accordingly, the first opening 64 is provided across the entire first wall portion other than the first wall portion 624 between the bump electrode 80 and the piezoelectric element 50.

The spacer 604 does not have a pair of second wall portions. The portion where the second wall portion is not provided is used as the first opening 644 and the second opening 65. The first opening 644 is provided across the second wall portion on the side of the bump electrode 80 with respect to the first wall portion 624, and the second opening 65 is provided across the second wall portion at the piezoelectric element 50 with respect to the first wall portion 624.

As such, only the first wall portion of the bump electrode 80 and the piezoelectric element 50 is provided. Since the first wall portion 624 suppresses gas from flowing toward the piezoelectric element 50 from the adhesive 61 disposed on the side of the bump electrode 80 with respect to the first wall portion 624, it is possible to prevent a problem of the piezoelectric element 50 due to the gas.

Fifth Modified Example

In the liquid discharge apparatus 10 illustrated in FIG. 3, the spacer 60 is provided so as to surround the bump electrode 80. As illustrated in a head 205 of FIG. 8, however, a spacer 605 may be provided so as to surround the piezoelectric elements 50 using first and second wall portions 625 and 635. In this case, the second wall portion 635 may be provided between the two first wall portions 625 adjacent to each other so as to interpose the column of the piezoelectric elements 50 therebetween, and have a second opening 655 provided at a part of the second wall portion 635 in the extension direction thereof.

That is, the pair of first wall portions 625 are disposed with a space formed in the orthogonal direction so as to interpose the column of the piezoelectric elements 50 therebetween, and positioned between the piezoelectric elements 50 and the bump electrodes 80, respectively. Furthermore, the pair of second wall portions 635 are disposed with a space formed in the arrangement direction so as to interpose the column of the piezoelectric elements 50 therebetween, and positioned between the adjacent bump electrodes 80.

Accordingly, no first wall portion is provided at the opposite side of the piezoelectric element 50 with respect to the bump electrode 80 in the orthogonal direction. The portion where no first wall portion is provided is used as a first opening 645. Therefore, the first opening 645 is provided across the first wall portion at the opposite side of the piezoelectric element 50 with respect to the bump electrode 80. Since the space of the spacer 625 on the side of the bump electrode 80 with respect to the first wall portion 625 is opened by the first opening 645, a pressure rise by the gas generated from the adhesive 61 is suppressed, which prevents separation of the bump electrode 80 by a pressure rise.

Similarly, in the space on the side of the bump electrode 80 with respect to the first wall portion 625 in the orthogonal direction, no second wall portion is provided outside the bump electrode 80 in the arrangement direction. The portion where no second wall portion is provided is used as the first opening 645. Therefore, the first opening 645 is provided across the second wall portion on the side of the bump electrode 80 with respect to the first wall portion 625. Since the space on the side of the bump electrode 80 with respect to the first wall portion 625 is opened by the first opening 645, a pressure rise by the gas generated from the adhesive 61 is suppressed, which prevents separation of the bump electrode 80 by a pressure rise.

The piezoelectric element 50 is surrounded by the first wall portion 625 between the bump electrode 80 and the piezoelectric element 50 and the second wall portion 635 on the side of the piezoelectric element 50 with respect to the bump electrode 80. Therefore, a gas flow of the adhesive 61 into the piezoelectric element 50 can be reduced, while a problem of the piezoelectric element 50 due to the gas can be suppressed.

The space on the side of the piezoelectric element 50 with respect to the bump electrode 80 is opened through the second opening 655 provided in the second wall portion 635 on the side of the piezoelectric element 50 with respect to the first wall portion 625. Therefore, the piezoelectric element 50 is not held in a closed space, but displacement interference of the piezoelectric element 50 in a closed space is suppressed.

The second opening 655 is provided at a part of the second wall portion 635 in the extension direction thereof. Therefore, the load of the second substrate 70 can be distributed and supported by the second wall portion 635 and the first wall portion 625.

Figure 8:
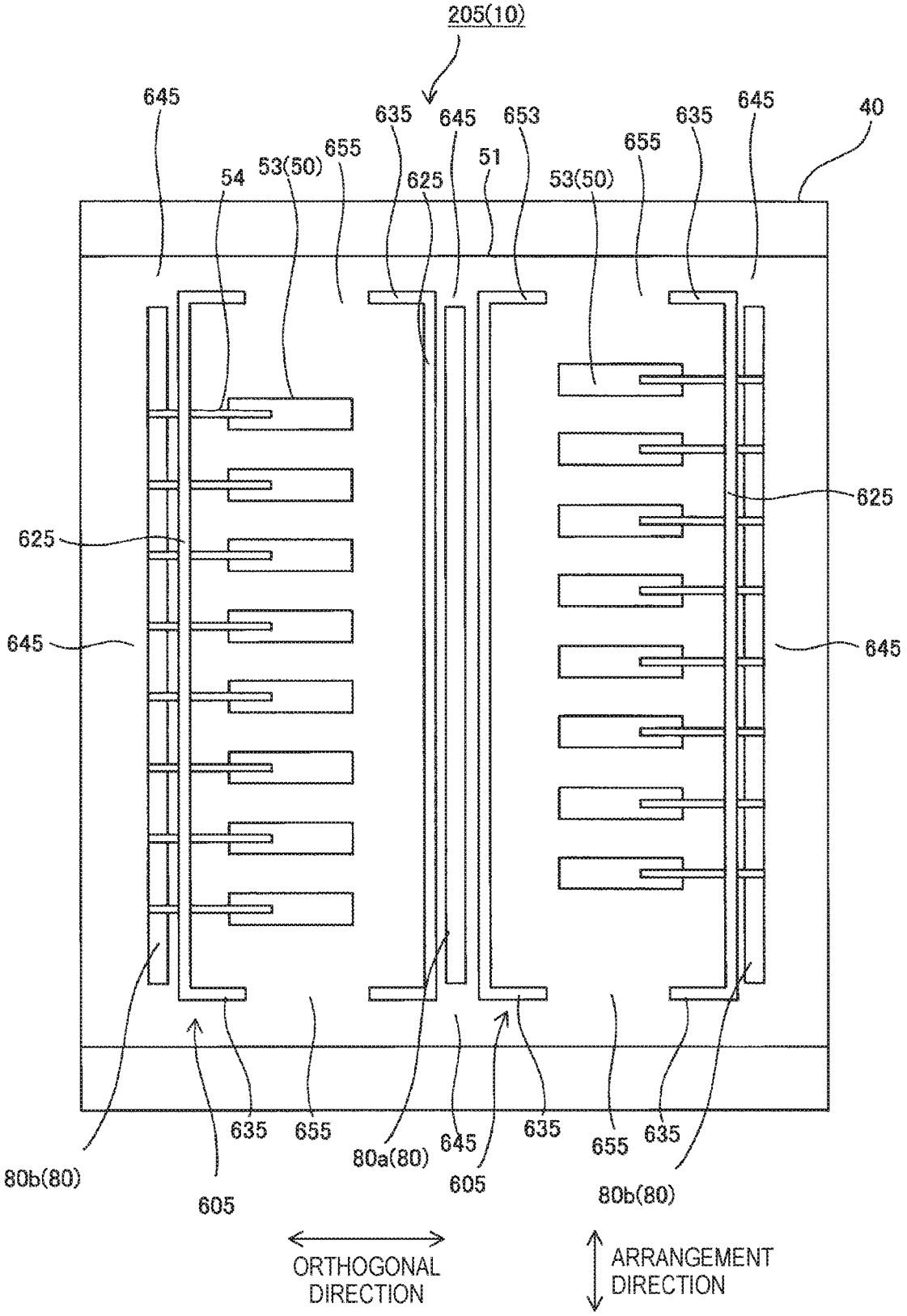
FIG. 8 illustrates a head on a first substrate of a liquid discharge apparatus according to a fifth modification of the first embodiment of this disclosure.

In the example of FIG. 8, no first and second wall portions are provided on the side of the bump electrode 80 with respect to the first wall portion 625. However, any one of the first and second wall portions may be provided. Even in this case, the portion where no wall portion is provided is used as the first opening 645. Therefore, the space on the side of the piezoelectric element 50 with respect to the bump electrode 80 can be opened, thereby preventing a problem due to the gas of the adhesive 61.

Sixth Modified Example

In the liquid discharge apparatus 10 illustrated in FIG. 3, the surface of the spacer 60, parallel to the stacking direction, is formed as the flat surface. However, the surface of the spacer 60 may be formed in a wave shape, or formed as a surface having notches provided thereon. In an example of a head 206 illustrated in FIG. 9, notches 66 are provided in a surface of a first wall portion 626, perpendicular to the orthogonal direction, and a surface of the second wall portion 646, perpendicular to the arrangement direction. The notches 66 have a triangular cross-sectional shape in a direction perpendicular to the stacking direction and extend in the stacking direction.

The surfaces of the first and second wall portions 626 and 636 have a larger length and area than the flat surface due to the notches 66. Therefore, the adhesive can spread to the respective surfaces of the first and second wall portions 626 and 636 or permeate and accumulate into the notches 66, thereby reducing a gas flow of the adhesive 61 toward the opposite side (outside) of the bump electrode 80 with respect to the spacer 606, the adhesive 61 adhering the spacer 606 and the first substrate 40 to each other. Therefore, the spread of the adhesive 61 toward the piezoelectric element 50 can be suppressed, while a problem of the piezoelectric element 50 by the adhesive 61 and the gas of the adhesive 61 is suppressed.

Figure 9:
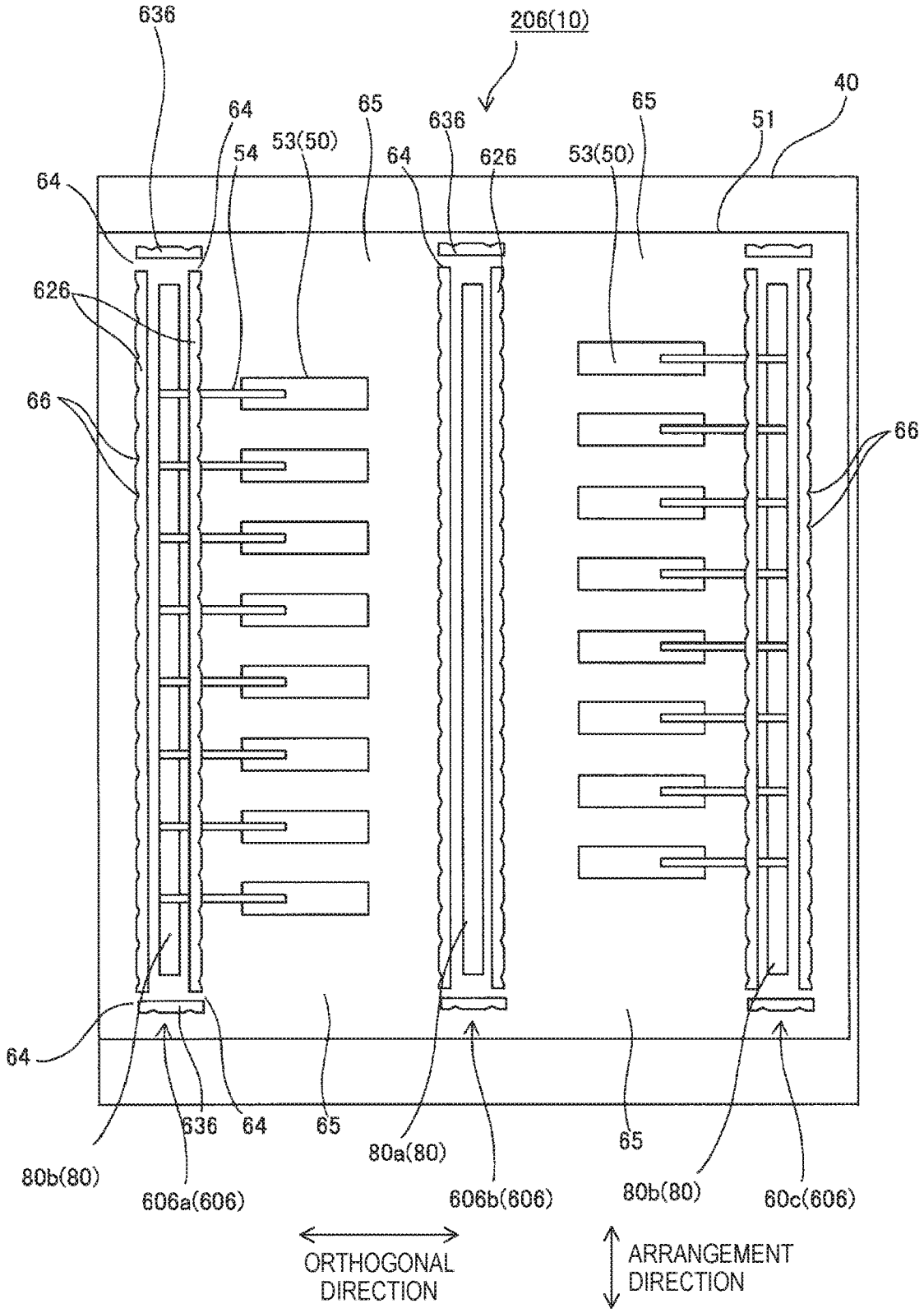
FIG. 9 illustrates a head on a first substrate of a liquid discharge apparatus according to a sixth modification of the first embodiment of this disclosure.

In the example of FIG. 9, the notches 55 have a triangular cross-sectional shape, but may have a curved cross-sectional shape such as a circular arc. In the example of FIG. 9, the notches 66 are provided in the surface (outer surface) of the spacer 606 on the side of the bump electrode 80. However, the notches 66 may be provided in at least the first wall portion 626 of the spacer 606 on the side of the piezoelectric element 50. For example, the notches 66 may be provided on the surface (inner surface) of the spacer 606 at the opposite side of the bump electrode 80.

Seventh Modified Example

In the liquid discharge apparatus 10 illustrated in FIG. 3, the dimension (width) of the first wall portion 62 (the first wall portion 62 on the side of the piezoelectric element) in the orthogonal direction, which is interposed between the piezoelectric element 50 and the bump electrode 80 in the spacer 60, is set to the same value as the width of the first wall portion 62 disposed at the opposite side of the piezoelectric element 50 with respect to the bump electrode 80 (the first wall portion 62 at the opposite side). However, the widths of the first wall portions 62 may be different from each other.

Figure 10:
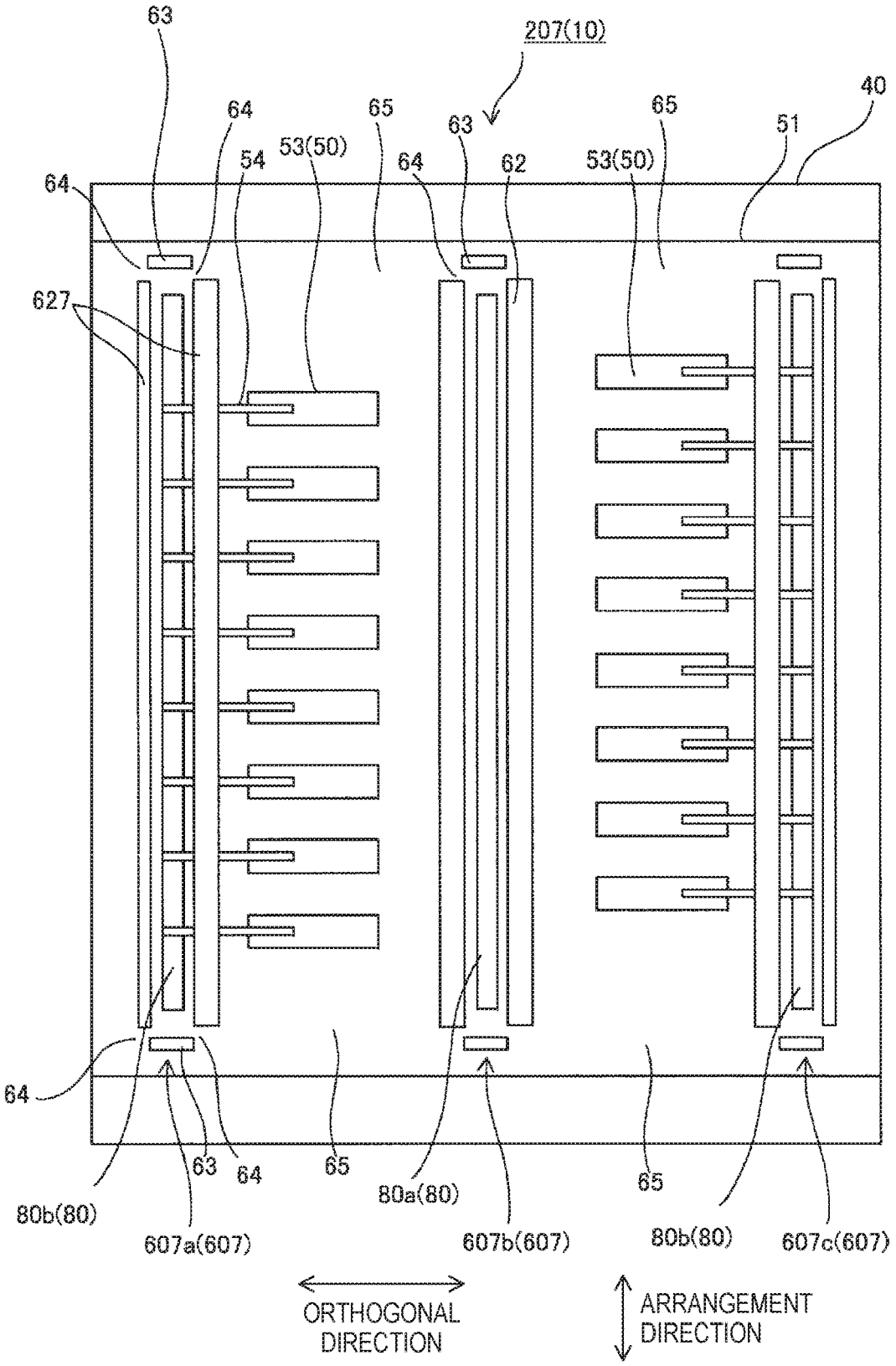
FIG. 10 illustrates a head on a first substrate of a liquid discharge apparatus according to a seventh modification of the first embodiment of this disclosure.

For example, as in a head 207 illustrated in FIG. 10, a first wall portion 627 of a spacer 607 on the side of the piezoelectric element may have a larger width than the first wall portion 627 at the opposite side. Accordingly, an adhesion area between the first substrate 40 and the first wall portion 627 on the side of the piezoelectric element is larger than an adhesion area between the first substrate 40 and the first wall portion 627 at the opposite side. Therefore, the adhesive 61 between the first substrate 40 and the first wall portion 627 on the side of the piezoelectric element is more difficult to spread than the adhesive 61 between the first substrate 40 and the first wall portion 627 at the opposite side, which prevents the adhesive 61 from adhering to the piezoelectric element 50.

Eighth Modified Example

In the liquid discharge apparatus 10 illustrated in FIG. 3, the first wall portion 62 (the first wall portion 62 on the side of the individual bump electrode) interposed between the piezoelectric element 50 and the individual bump electrode **80*b* in the spacer 60 has the same width as the first wall portion 62 (the first wall portion 62 on the side of the common bump electrode) interposed between the piezoelectric element 50 and the common bump electrode 80*a*. However, the widths of the first wall portions 62** may be different from each other.

Figure 11:
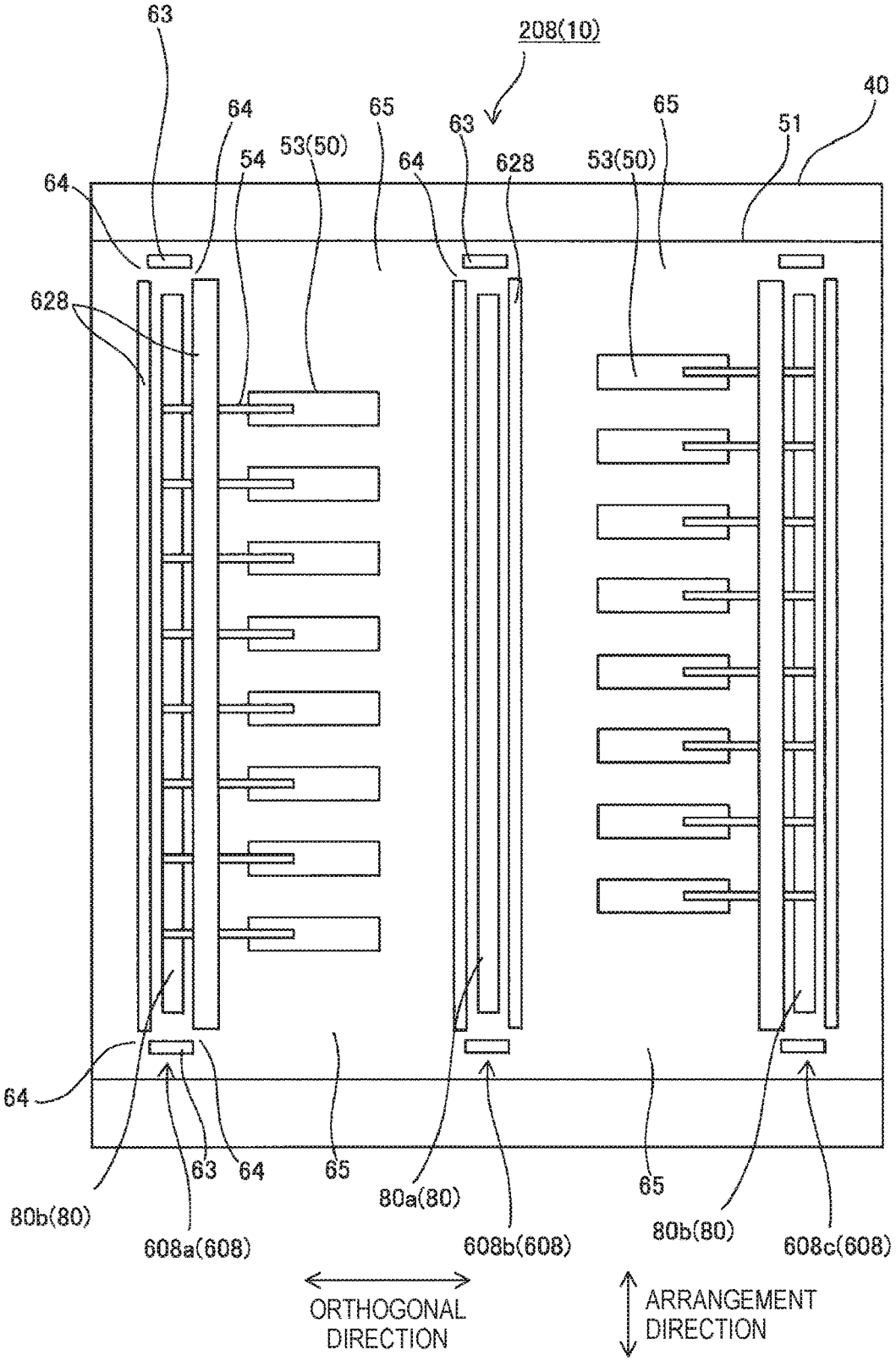
FIG. 11 illustrates a head on a first substrate of a liquid discharge apparatus according to an eighth modification of the first embodiment of this disclosure.

For example, as in a head 208 illustrated in FIG. 11, the width of a first wall portion 628 of a spacer 608 on the side of the individual bump electrode may be set to a lager value than the width of the first wall portion 628 on the side of the common bump electrode. Since the plurality of individual conductors 54 extend between the first substrate 40 and the first wall portion 628 on the side of the individual bump electrode, a gap is formed therebetween, such that the adhesive 61 easily flows to the outside from the gap. However, since the adhesion area between the first substrate 40 and the first wall portion 628 on the side of the individual bump electrode becomes larger than the adhesion area between the first substrate 40 and the first wall portion 628 on the side of the common bump electrode, the adhesive 61 hardly spreads from the gap, which suppresses the adhesive 61 from adhering to the piezoelectric element 50.

Ninth Modified Example

In the liquid discharge apparatus illustrated in FIG. 3, the openings 64 and 65 have the same length as the distance between the first and second substrates 40 and 70 in the stacking direction. However, the openings 64 and 65 may have a smaller length than the distance. In this case, within the formation range of the openings 64 and 65, the spacer 60 extends from the second substrate 70 toward the first substrate 40, and the openings 64 and 65 are provided at the end of the spacer 60. Therefore, between the first and second substrates 40 and 70, the spacer 60 is provided at the second substrate 70, and the openings 64 and 65 are provided at the first substrate 40. On the contrary, between the first and second substrates 40 and 70, the spacer 60 may be provided at the first substrate 40, and the openings 64 and 65 may be provided at the second substrate 70.

Second Embodiment

In the liquid discharge apparatus 10 according to the first embodiment, the space on the side of the bump electrode 80 with respect to the spacer 60 is opened by the first openings 64 provided at portions other than the portions positioned between the piezoelectric elements 50 and the bump electrode 80 in the spacer 60. In a liquid discharge apparatus 10 according to a second embodiment, however, a head 210 illustrated in FIG. 12 has a structure in which a space on the side of the bump electrode 80 with respect to a spacer 610 is opened by an opening (third opening 73) provided in the second substrate 70 (FIG. 2). In order to promote understandings, the illustration of the second substrate 70 is omitted from FIG. 12.

Specifically, a pair of first wall portions 6210 in the spacer 610 are disposed so as to interpose the bump electrode 80 therebetween in the orthogonal direction. Furthermore, a pair of second wall portions 6310 are disposed so as to interpose the bump electrode 80 therebetween in the arrangement direction, while connecting the pair of first wall portions 6210 in the orthogonal direction. Since the ends of the first wall portions 6210 and the ends of the second wall portions 6310 are connected to each other, the spacer 610 has a rectangular frame shape to surround the bump electrode 80. The third opening 73 is provided in the second substrate 70 within the surrounded space (holding space).

The third opening 73 is formed through the second substrate 70 in the stacking direction, as a though hole, and connects the holding space with a space outside the holding space. For example, the second substrate 70 may include a substrate through which a through-electrode is provided in the stacking direction. In this case, the third opening 73 can be formed in the second substrate 70 at the same time as the through-electrode, which makes it possible to reduce the number of operation processes.

The third opening 73 is provided around the bump electrode 80 in the holding space of the spacer 610. As the third opening 73 is disposed in the second substrate 70 between the spacer 610 and the bump electrode 80, the third opening 73 is not interposed between the bump electrode 80 and the second terminal 71 (FIG. 2) of the second substrate 70, and does not interfere with connection therebetween.

In the rectangular holding space of the spacer 610, one or more third openings 73 (for example, four third openings) are provided. The four third openings 73 are disposed in the four corners of the spacer 610 at which the first wall portion 6210 and the second wall portion 6310 are connected to each other.

As such, the holding space formed by the spacer 610 (the space on the side of the bump electrode 80 with respect to the spacer 610) is opened through the third openings 73, and the gas of the adhesive 61 flows to the external space from the holding space through the third openings 73. Therefore, a pressure rise in the holding space by the gas can be reduced, and an adhesion defect of the bump electrode 80 by the pressure rise can be suppressed. Furthermore, since the gas hardly flows toward the piezoelectric element 50, it is possible to prevent a problem such as deterioration of the piezoelectric element 50 by the gas.

Tenth Modified Example

Figure 12:
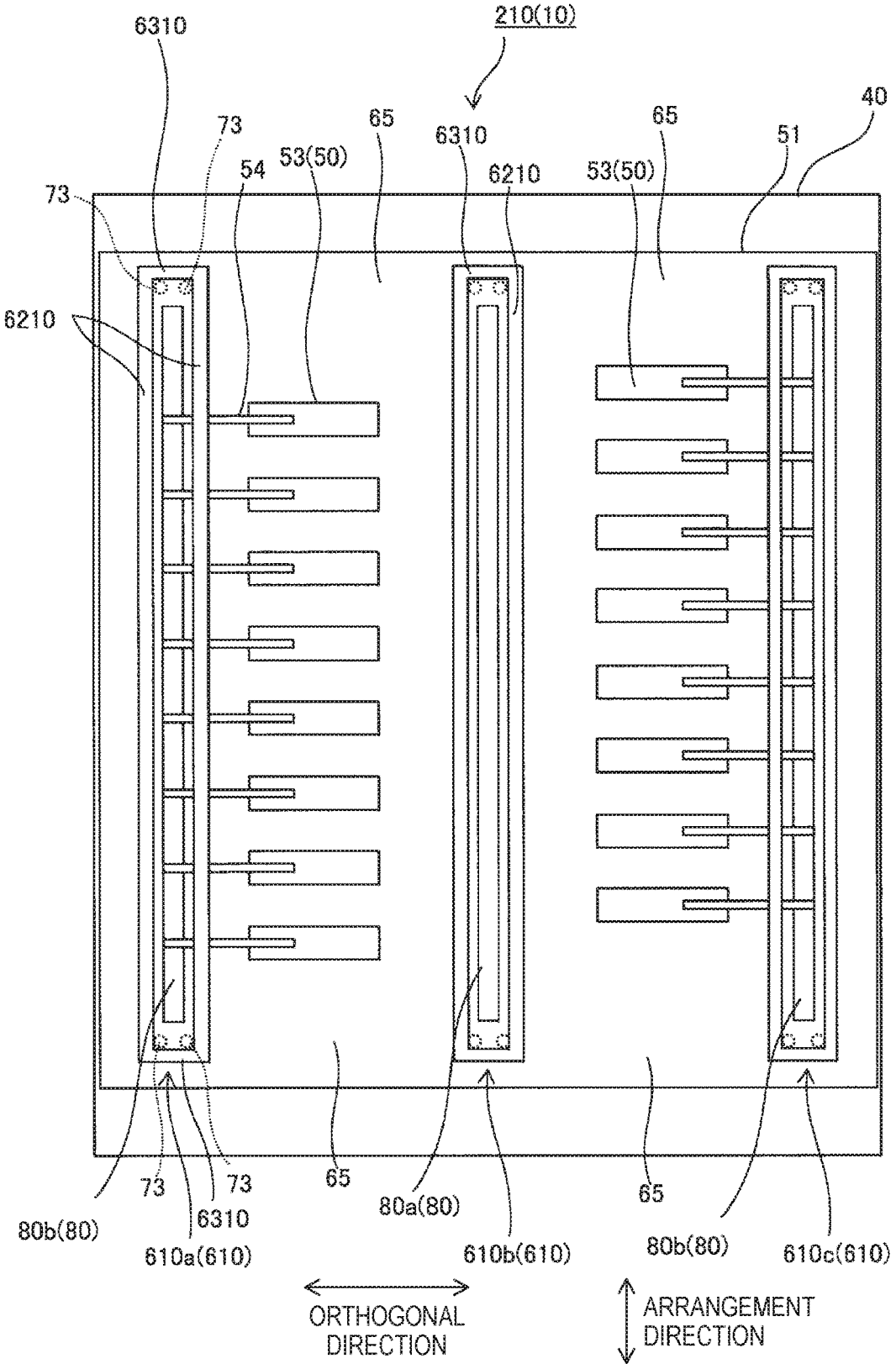
FIG. 12 illustrates a head on a first substrate of a liquid discharge apparatus according to a second embodiment of this disclosure.
Figure 13:
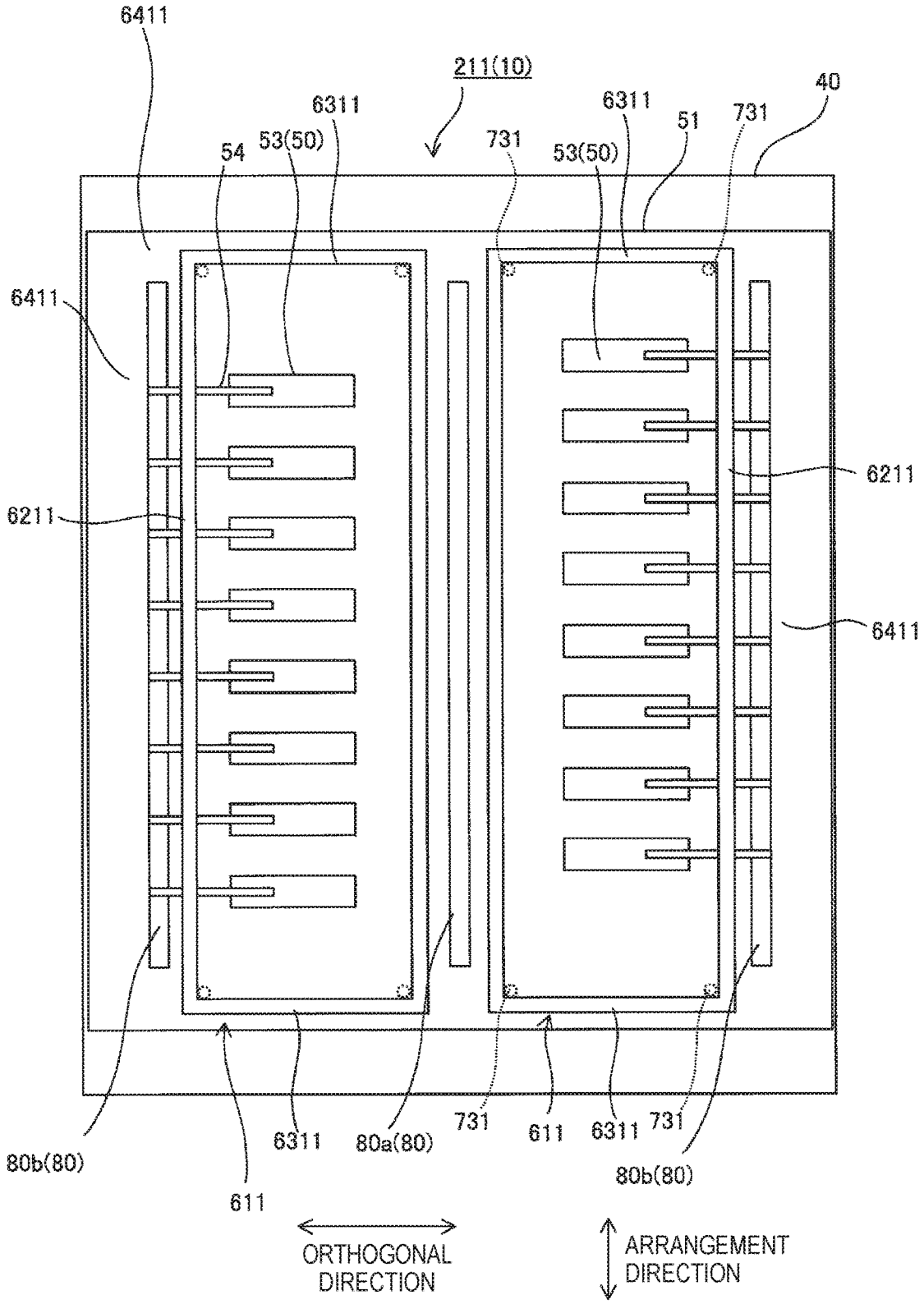
FIG. 13 illustrates a head on a first substrate of a liquid discharge apparatus according to a tenth modification of the second embodiment of this disclosure.

In the liquid discharge apparatus 10 illustrated in FIG. 12, the space on the side of the bump electrode 80 with respect to the spacer 610 is opened through the third openings 73. However, a head 211 illustrated in FIG. 13 may have a structure in which a space on the side of the piezoelectric element 50 with respect to a spacer 611 is opened by third openings 731.

In this case, a pair of first wall portions 6211 of the spacer 611 interpose the column of the piezoelectric elements 50 therebetween in the orthogonal direction, and a pair of second wall portions 6311 interpose the column of the piezoelectric elements 50 therebetween in the arrangement direction. The ends of the first wall portions 6211 and the ends of the second wall portions 6311 are connected to each other, such that the spacer 611 surrounds the column of the piezoelectric elements 50. The third openings 731 are provided in the second substrate 70 within the surrounded space (holding space).

The holding space formed by the spacer 611 (the space on the side of the piezoelectric element 50 with respect to the spacer 611) is opened through the third openings 731, and the gas of the adhesive 61 flows to the external space from the holding space through the third openings 731. Therefore, a pressure rise in the holding space by the gas can be reduced, and a problem such as displacement interference of the piezoelectric element 50 by the pressure rise can be suppressed. Furthermore, since the gas hardly flows toward the piezoelectric element 50, it is possible to prevent a defect such as deterioration of the piezoelectric element 50.

The first and second wall portions are not provided on the side of the bump electrode 80 with respect to the first wall portion 6210, but the portion where the first and second wall portions are not provided is used as a first opening 6411. Therefore, since the space on the side of the bump electrode 80 with respect to the first wall portion 6211 is opened through the first opening 6411, it is possible to prevent separation of the bump electrode 80 by a pressure rise.

Eleventh Modified Example

Figure 14:
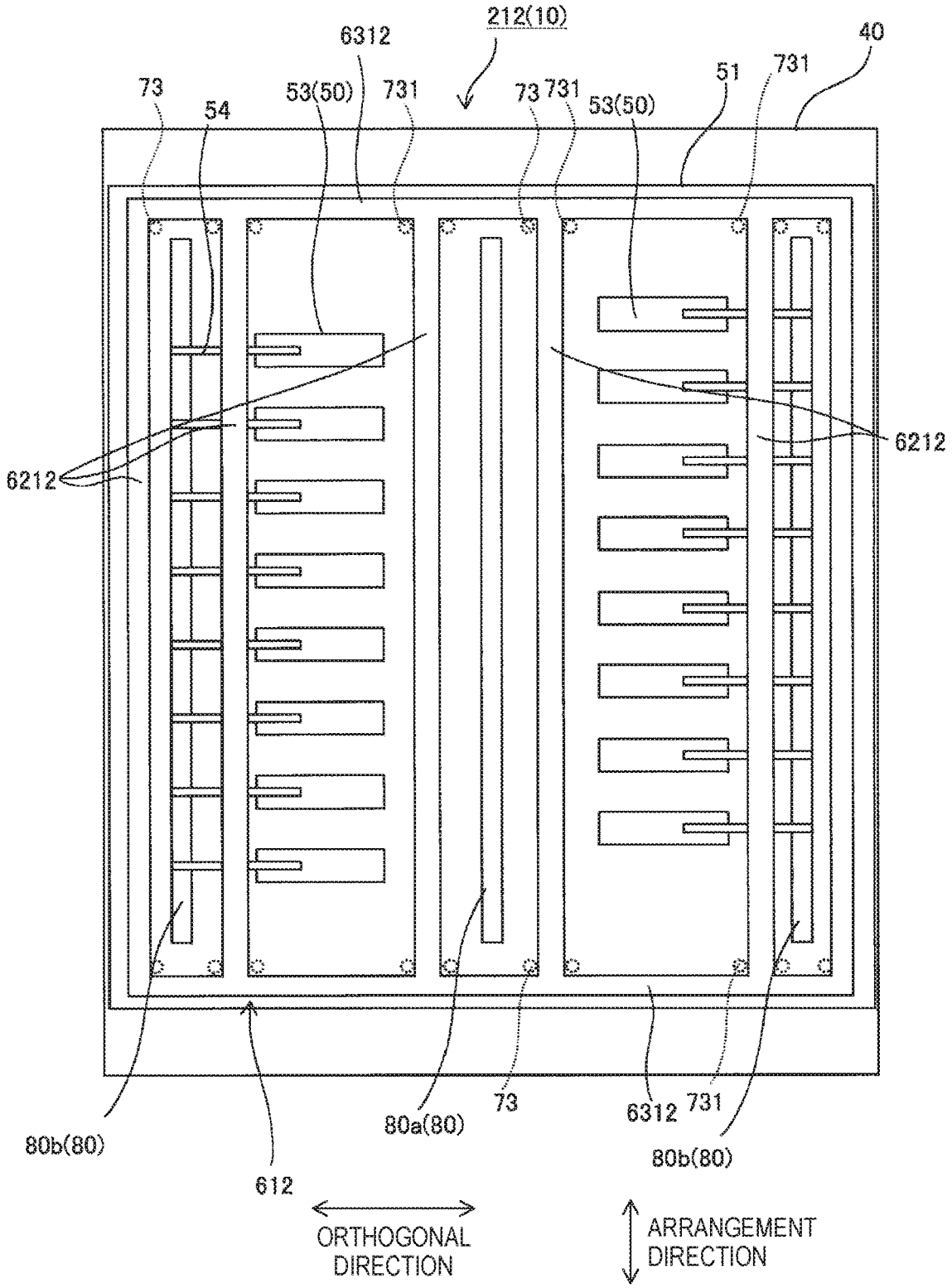
FIG. 14 illustrates a head on a first substrate of a liquid discharge apparatus according to an eleventh modification of the second embodiment of this disclosure.

In the liquid discharge apparatus 10 illustrated in FIG. 12, the space on the side of the bump electrode 80 with respect to the spacer 610 is opened through the third openings 73. Furthermore, in the tenth modification, however, the space on the side of the piezoelectric element 50 with respect to the spacer 611 is opened through the third opening s731. However, a head 212 illustrated in FIG. 14 has a structure in which a spacer 612 surrounds the bump electrode 80 and the column of the piezoelectric elements 50 using first and second wall portions 6212 and 6312. Furthermore, the space on the side of the bump electrode 80 with respect to the spacer 612 is opened through the third openings 73, and the space on the side of the piezoelectric element with respect to the spacer 612 may be opened through the third openings 731.

Twelfth Modified Example

In the liquid discharge apparatuses 10 of FIG. 12 and the tenth and eleventh modifications, the third openings 73 and 731 are provided in the second substrate 70. However, the third openings 73 and 731 may be provided in the first substrate 40 or both of the first and second substrates 40.

Other Embodiments

In all of the above-described embodiments, the spacer 611 and the first substrate 40 may be attached through the adhesive 61. However, the spacer 611 and the second substrate 70 may be attached through the adhesive 61. In this case, the spacer 611 extends from the first substrate 40 to the second substrate 70.

All of the above-described embodiments may be combined with each other as long as they do not exclude each other. For example, in the liquid discharge apparatus 10 according to any one of the first and second embodiments, the first to fourth modifications and the sixth to ninth modifications, the second opening 655 may be provided at a part of the second wall portion 635 in the extension direction thereof, the second wall portion 635 interposing the piezoelectric element 50 therebetween, as in the fifth modification. In the liquid discharge apparatus 10 according to any one of the first and second embodiments and the first to twelfth modifications, the surface of the spacer 606 may be formed in a wave shape or have the notches 66 provided thereon as in the sixth embodiment. In the liquid discharge apparatus 10 according to any one of the first and second embodiments and the first to twelfth modifications, the first wall portion 627 on the side of the piezoelectric element may have a larger width than the first wall portion 627 at the opposite side as in the seventh modification. In the liquid discharge apparatus 10 according to any one of the first and second embodiments and the first to twelfth modifications, the first wall portion 628 on the side of the individual bump electrode may have a larger width than the first wall portion 628 on the side of the common bump as in the eighth modification. In the liquid discharge apparatus 10 according to any one of the first and second embodiments and the first to eleventh modifications, the openings 64 and 65 may have a smaller length than the distance between the first and second substrates 40 and 70 in the stacking direction as in the ninth modification.

From the above descriptions, it is obvious to those skilled in the art that this disclosure can be improved in various manners and modified into other embodiments. Therefore, the above descriptions should be analyzed as examples, and provided to instruct those skilled in the art of the best mode for embodying this disclosure. Furthermore, the details of the structures and/or functions of this disclosure can be substantially changed without departing the spirit of this disclosure.

What is claimed is:

1. A liquid discharge apparatus comprising:

a channel substrate, which has a pressure chamber communicating with a nozzle;

a first substrate, which is disposed on the channel substrate;

a piezoelectric element, which is disposed on the first substrate so as to correspond to the pressure chamber;

a spacer, which is provided on a surface of the first substrate on which the piezoelectric element is disposed;

a second substrate, which is stacked over the first substrate with the spacer interposed therebetween; and a bump electrode, which communicates with the piezoelectric element and electrically connects a first terminal provided on the first substrate with a second terminal provided on the second substrate, wherein the spacer is provided between the bump electrode and the piezoelectric element and attached to at least one of the first and second substrates by an adhesive, wherein both a space on a side of the piezoelectric element with respect to the spacer and a space on a side of the bump electrode with respect to the spacer are opened by at least one of a portion other than a portion of the spacer positioned between the piezoelectric element and the bump electrode and an opening provided in at least one of the first and second substrates, wherein the spacer includes a pair of first wall portions extending in an arrangement direction in which a plurality of piezoelectric elements are arranged and a pair of second wall portions extending in an orthogonal direction to the arrangement direction so as to surround the bump electrode or the piezoelectric element, and wherein the opening is provided in at least one of the second wall portions and one of the pair of first wall portions, which is provided at the opposite side of the piezoelectric element with respect to the bump electrode.

2. The liquid discharge apparatus according to claim 1, wherein the opening is provided at a part of the at least one of the second wall portions and the one of the pair of first wall portions.

3. The liquid discharge apparatus according to claim 1, wherein the opening is provided at one second wall portion of the pair of second wall portions, and wherein, in adjacent spacers among a plurality of spacers, the opening is provided at the other second wall portion of the pair of second wall portions.

4. The liquid discharge apparatus according to claim 1, wherein the opening is provided at a position of one second wall portion of the pair of second wall portions which is closer to the center of a plurality of spacers arranged in the orthogonal direction.

5. The liquid discharge apparatus according to claim 1, wherein the spacer includes a first wall portion extending in an arrangement direction along which the plurality of piezoelectric elements are arranged, and wherein, in the first wall portion disposed on the side of the piezoelectric element with respect to the bump electrode, the width of the first wall portion in an orthogonal direction to the arrangement direction is larger than the width of the first wall portion disposed at the opposite side of the piezoelectric element with respect to the bump electrode.

6. The liquid discharge apparatus according to claim 1, wherein the spacer includes a first wall portion extending in an arrangement direction in which the plurality of piezoelectric elements are arranged, wherein the piezoelectric element includes a discrete electrode provided for each of the piezoelectric elements, a common electrode provided across the plurality of piezoelectric elements, and a piezoelectric body interposed between the discrete electrode and the common electrode, and wherein, in the first wall portion disposed between the piezoelectric element and the bump electrode electrically connected to the discrete electrode, the width of the first wall portion in an orthogonal direction to the arrangement direction is larger than the width of the first wall portion disposed between the piezoelectric element and the bump electrode electrically connected to the common electrode.

7. A liquid discharge apparatus comprising:

a channel substrate, which has a pressure chamber communicating with a nozzle;

a first substrate, which is disposed on the channel substrate;

a piezoelectric element, which is disposed on the first substrate so as to correspond to the pressure chamber;

a spacer, which is provided on a surface of the first substrate on which the piezoelectric element is disposed;

a second substrate, which is stacked over the first substrate with the spacer interposed therebetween; and a bump electrode, which communicates with the piezoelectric element and electrically connects a first terminal provided on the first substrate with a second terminal provided on the second substrate, wherein the spacer is provided between the bump electrode and the piezoelectric element and attached to at least one of the first and second substrates by an adhesive, wherein both a space on a side of the piezoelectric element with respect to the spacer and a space on a side of the bump electrode with respect to the spacer are opened by at least one of a portion other than a portion of the spacer positioned between the piezoelectric element and the bump electrode and an opening provided in at least one of the first and second substrates, wherein the spacer is provided to continuously surround the bump electrode or the piezoelectric element, and wherein the opening is provided at a portion within a range surrounded by the spacer in at least one of the first and second substrates, to communicate the space surrounded by the spacer with the outside of the space.

8. The liquid discharge apparatus according to claim 7, wherein the opening is a through hole provided in the at least one of the first and second substrates between the bump electrode and the spacer.

9. The liquid discharge apparatus according to claim 7, wherein the opening is a through hole provided at each of four corners of a rectangular internal space surrounded by the spacer in the first substrate or the second substrate.

* * * * *